United States Patent [19]

Ausbrooks

[11] 4,403,016

[45] Sep. 6, 1983

[54] GOLD-COLORED SILVER-CADMIUM-NICKEL ALLOY FOR ELECTRODEPOSITED DUPLEX COATING

[75] Inventor: Charles Ausbrooks, Sheridan, Ark.

[73] Assignee: Timex Corporation, Waterbury, Conn.

[21] Appl. No.: 417,806

[22] Filed: Sep. 13, 1982

Related U.S. Application Data

[62] Division of Ser. No. 213,138, Dec. 4, 1980, abandoned.

[51] Int. Cl.[3] ..... B32B 15/00

[52] U.S. Cl. ..... 428/672; 428/673; 368/280; 368/295

[58] Field of Search ..... 368/280, 295; 428/670, 428/672, 673; 420/501, 506; 148/430, 431

[56] References Cited

U.S. PATENT DOCUMENTS

| | | | |
|---|---|---|---|
| 1,548,432 | 8/1925 | Belous | 204/46 |
| 1,896,410 | 2/1933 | Leach | 75/173 R |
| 2,080,811 | 5/1937 | Emmert | 75/173 C |
| 2,151,905 | 3/1939 | Emmert | 75/173 C |
| 2,311,436 | 2/1943 | Gwynn, Jr. | 75/173 R |
| 3,953,246 | 4/1976 | Wilson et al. | 148/11.5 R |

FOREIGN PATENT DOCUMENTS 1451486 10/1976 United Kingdom .

OTHER PUBLICATIONS

Brenner, A. *Electrodeposition of Alloy, Principles and Practice,* vol. I, Academic Press, pp. 658–678, (1963).

E. Raub and B. Wollhurst, Der Aufbare Galvanischer Legierungsniedersläge, 4 Die Silber–Kadmium Legierungen, *Metalforsch.* 2, 33–41 (1947).

*Primary Examiner*—Michael L. Lewis

*Attorney, Agent, or Firm*—William C. Crutcher

[57] ABSTRACT

Disclosed is a silver-cadmium-nickel alloy coating including small but effective amounts of cadmium and nickel, namely, at least, about 6 weight percent cadmium and 0.5 weight percent nickel, to impart a gold-color to the coating substantially equivalent to that of a 12–16 karat gold layer of similar thickness. The gold-colored alloy coating can replace a 12 karat gold inner layer in a duplex coating having a 22 karat gold outer layer, and thereby provide substantial savings in gold.

A highly alkaline aqueous cyanide plating bath is employed in the electroplating process in conjunction with increased current density to ensure that a critical minimum amount of cadmium is deposited in the alloy coating.

3 Claims, No Drawings

GOLD-COLORED SILVER-CADMIUM-NICKEL ALLOY FOR ELECTRODEPOSITED DUPLEX COATING

This application is a division of application Ser. No. 213,138, filed Dec. 4, 1980, now abandoned.

FIELD OF THE INVENTION

The present invention relates to an alloy coating which is gold in color but contains no gold metal for use as a decorative coating on jewelry and other articles, and to an electroplating process and bath composition to deposit such a coating.

DESCRIPTION OF THE PRIOR ART

In the past, a duplex coating comprising an inner 12 karat gold layer and outer 22 karat gold layer, each about one micron in thickness, has been electroplated onto visible timepiece components such as the bezel and crown to impart an attractive appearance thereto. This duplex coating has proved satisfactory from the standpoint of color, corrosion resistance, wear resistance and adhesion but with the recent soaring price of gold, the duplex coating has increased significantly in cost. Tremendous increases in manufacturing costs have resulted when such a duplex coating is utilized as a decorative coating on mass-produced products such as wristwatches. Thus, there is an urgent need to find alternative gold-colored coatings for such uses which contain reduced amounts of gold.

One approach to satisfy this need is exemplified in the Belous U.S. Pat. No. 1,548,432 issued Aug. 4, 1925 which employs on a brass musical instrument an inner electroplated nickel layer followed by an intermediate gold-colored brass layer (e.g., 88% Cu-12% Zn-free of Fe) with a thin outer gold layer electroplated over the intermediate brass layer. Optionally, a silver coating can be deposited on the nickel layer prior to deposition of the gold-colored brass layer. In the event the outer gold layer is worn off, the gold-color of the brass layer will be evident and maintain a gold appearance to the user.

SUMMARY OF THE INVENTION

An object of the present invention is to provide a novel alloy coating which exhibits a gold color substantially similar to a 12–16 karat gold layer of similar thickness.

Another object of the invention is to use such a novel alloy coating in lieu of the 12 karat gold inner layer of the duplex coating described hereinabove, thereby substantially reducing the amount of gold in the duplex coating and decreasing its cost.

Still another object of the invention is to provide an electroplating process and bath composition for depositing the novel alloy coating on a substrate.

An important feature of the present invention relates to the discovery that the inclusion of small but effective amounts of cadmium and nickel in a silver-nickel-cadmium alloy coating will impart a gold-color thereto substantially similar to a 12 or 16 karat gold layer of similar thickness. Generally, at least about 6 weight percent of cadmium and at least about 0.5 weight percent nickel must be included in the alloy coating to achieve the desired color. A nominal alloy coating composition consisting essentially of 88.0 weight percent silver, 9.92 weight percent cadmium and 0.53 weight percent nickel and optionally 1.5 weight percent indium has been found to provide such a gold-colored alloy coating.

A duplex coating according to another aspect of the invention typically includes an inner, gold-colored alloy coating having the composition just described and an outer gold alloy layer, e.g., a 22 karat outer gold layer. This duplex coating is equivalent in adhesion, color and corrosion resistance to the 12 karat gold/22 karat gold duplex coating when tested at the same coating thicknesses. It is apparent that substitution of the silver-cadmium-nickel alloy layer of the invention for the 12 karat gold inner layer of the prior art duplex coating results in a substantial savings in gold.

The electroplating process of the present invention utilizes a highly alkaline aqueous cyanide plating solution. An important feature of the process involves the discovery that the amount of cadmium deposited in the alloy coating increases with increased current density and that a critical minimum current density is necessary to achieve the critical cadmium level in the coating, namely, at least 6 weight percent cadmium, for imparting the desired gold color thereto. Still another important feature of the invention is the discovery that a highly alkaline aqueous cyanide plating bath with increased levels of free cyanide are necessary to maintain proper brightness of the silver-cadmium-nickel alloy coating.

DESCRIPTION OF PREFERRED EMBODIMENTS

The gold-colored silver-cadmium-nickel-indium (optional) alloy coating of the invention is deposited from a plating bath having the following composition:

Plating Solution silver (present as cyanide)—4–6 gm/l
cadmium (present as cyanide)—4–8 gm/l
nickel (present as cyanide or hydroxide)—2–5 gm/l
indium (present as indium sulfate)—1–3 gm/l
free cyanide—100–150 gm/l
Lea Ronal surface wetting Agent A—2–3% by volume
Lea Ronal surface wetting Agent B—1.5–2.5 gm/l
pH—11.5–12.5

The temperature of the plating solution is maintained between 55° F. to 70° F. and is mildly agitated with continuous filtration. Stainless steel anodes have performed satisfactorily in the process.

The above-described plating solution was prepared by purchasing a standard commercially available aqueous electroplating solution sold under the name Eterna 12 Makeup by Lea Ronal, 272 Buffalo Avenue, Freeport, N.Y. The purchased solution contains indium in the amounts indicated in the table and the surface wetting agents A and B in the amounts indicated. The silver, nickel and cadmium components were subsequently added to the purchased plating solution in the amounts indicated and the pH and free cyanide are also brought up to the prescribed levels (free cyanide of purchased solution is 0 gm/l and pH is 10.5–11.5). As mentioned hereinabove, it is important to increase the level of free cyanide and the pH in order to provide an alloy coating with satisfactory brightness and to minimize hazing. When these bath parameters are maintained within the ranges set forth in the table, satisfactory coating brightness is achieved. During plating, the electroplating solution was replenished periodically as needed to maintain the solution composition. Surface wetting agents A and B were replenished by adding appropriate amounts of commercially available solutions sold under the name Solution A and Solution B by Lea Ronal. These solutions contain the respective wetting agents, and Solution B also contains indium for replenishment purposes.

The Lea Ronal surface wetting agents A and B were found to be necessary in the plating solution in order to achieve a silver-cadmium-nickel-indium alloy coating having proper thickness, density and color.

Another important parameter of the electroplating process which must be controlled is current density. When plating with the above-described solution, current density preferably is maintained at least about 4 amp/ft$^2$, more preferably 5 to 8 amps/ft$^2$. As already mentioned, this minimum critical current density is necessary to ensure that the amount of cadmium in the alloy coating is at least about 6 weight percent to provide the desired gold-color. Through coating trials, it was discovered that the amount of cadmium in the alloy coating increased with increasing current density. For example, at 4 amps/ft$^2$, the amount of cadmium in the alloy coating, was about 6 weight percent. At 8 amps/ft$^2$, the cadmium concentration increased to 9 weight percent. Recognition of this relationship between current density and cadmium content of the coating is an important feature of the invention.

Of course, another important feature of the invention is the discovery that cadmium in the amount of at least about 6 weight percent and nickel in the amount of at least about 0.5 weight percent in a silver-cadmium-nickel alloy coating provides a coating having a gold-color substantially similar to a 12 karat or 16 karat gold layer. For example, when the cadmium content of the alloy coating was 0 weight percent (Ag 90 w/o, Ni 3 w/o, In 2 w/o), the color of the coating was observed to be white and hazy. However, when the cadmium content was 9.92 weight percent and nickel was 0.53 weight percent (Ag 88 w/o, In 1.5 w/o), the color of the coating was equivalent to that of a 12 or 16 karat gold layer. Generally, when the alloy coating consists essentially of 85 to 90 weight percent silver, 6 to 10 weight percent cadmium, 0.5 to 1 weight percent nickel and up to 2 weight percent indium, the coating color will substantially resemble the color of a 12 or 16 karat gold layer of similar thickness. The discovery that the addition of a small but critical minimum amount of both cadmium and nickel produces such a gold color was surprising and unexpected from prior art teachings.

The gold-colored silver-cadmium-nickel alloy coating is particularly useful as an inner layer in a duplex coating having a thin gold outer layer, e.g., a 22 karat gold outer layer. For example, watch bezels having a copper coating (2.5 average micron thickness) and a nickel coating thereover (17 average micron thickness) were electroplated according to the process described hereinabove to deposit a 1 micron (average thickness) layer of the silver-cadmium-nickel-indium alloy coating of the invention and then to deposit a 22 karat gold outer layer thereover. These bezels were then evaluated with bezels having a 12 karat gold/22 karat gold duplex coating thereon (specifically 2.5 microns copper, 19.0 microns nickel, 0.8 micron 12 karat gold, 1.0 micron 22 karat gold). The bezels having the duplex coating of the invention were equivalent to the bezels with the 12 karat/22 karat duplex coating in adhesion, color (Hamilton #7 color achieved), corrosion resistance (hydrogen sulfide-4 hrs., nitric acid fumes-4 hrs, humidity-100° F./90% R.H. for 5 days and artificial perspiration-7 weeks) and fading resistance from sunlight. In a tumbling eraser wear test, the bezels of the invention showed only slightly less wear resistance than the 12 karat/22 karat coating bezels.

Those skilled in the art will recognize that the gold-colored alloy coating of the invention may find use as a coating alone or in combination with other coatings on a myriad of articles including jewelry. And, those skilled in the art will recognize that other modifications and changes may be made to the preferred embodiments and it is desired to cover in the appended claims all such modifications and changes as fall within the true spririt and scope of the invention.

I claim:

1. A coated article having thereon a duplex coating comprising a substrate with a first gold-colored coating consisting essentially of, by weight, about 85 to 90% silver, about 0.5 to 1% nickel, about 6 to 10% cadmium and up to about 2% indium and a second coating deposited on said first coating, said second coating being a gold containing alloy.

2. The coated article of claim 1 wherein the second coating is 22 karat gold.

3. The coated article of claim 2 which is a timepiece bezel.

* * * * *